United States Patent [19]

Urquhart

[11] Patent Number: 4,967,487

[45] Date of Patent: Nov. 6, 1990

[54] OVEN FOR THE CURING AND COOLING OF PAINTED OBJECTS AND METHOD

[76] Inventor: Gordon T. Urquhart, 517 S. Glenhurst, Birmingham, Mich. 48009

[21] Appl. No.: 185,779

[22] Filed: Apr. 25, 1988

[51] Int. Cl.[5] ..... F26B 19/00

[52] U.S. Cl. ..... 34/66; 34/39; 34/187; 34/218; 118/642

[58] Field of Search ..... 34/4, 39, 60, 66, 187, 34/218; 118/641, 642, 643

[56] References Cited

U.S. PATENT DOCUMENTS

| | | | |
|---|---|---|---|
| 2,498,339 | 2/1950 | Miskella | 118/642 |
| 4,026,036 | 5/1977 | Tanaka | 34/66 |
| 4,600,491 | 7/1986 | Urquhart et al. | 34/4 X |
| 4,621,187 | 1/1986 | Petro, Jr. | 118/642 |
| 4,665,626 | 5/1987 | Berkman et al. | 34/39 X |

*Primary Examiner*—Henry A. Bennet
*Assistant Examiner*—John Sollecito

[57] ABSTRACT

An open top oven (10) for curing and cooling a painted object such as a vehicle body (12) comprising a plurality of ducts (62,64,70,72,74) for selectively supplying air at different times in the paint curing and cooling process, including a plurality of quartz lamps (92) selectively spaced from the vehicle body (12) which are used to controllably raise the temperature of the body. A mechanism, supported by a cover (50) which cover encloses the oven, is provided to oscillate the body during paint curing and subsequent cooling.

31 Claims, 4 Drawing Sheets

50
162a
160a
162b
162c
162d
160b
150

50
LAMPS
110
414
66a
70a
70b
74a
62
66b
100
404
404
400
401
402
410
411
420

OVEN FOR THE CURING AND COOLING OF PAINTED OBJECTS AND METHOD

BACKGROUND AND SUMMARY OF THE INVENTION

The present invention relates generally to ovens and cool-off tunnels for curing and cooling painted objects and more particularly to a top entry oven for curing automotive vehicle bodies that have received a first or prime coat of paint.

It has been common practice within the automotive industry that after the prime coat layer of paint has been applied to an automotive body, such automotive body is moved through a drag-through oven to cure the prime coat and then through a cool-off tunnel. Drag-through ovens are characterized by excess heat loss, increased contamination to the surrounding environment, and more importantly are not able to uniformally raise the temperature of the skin of the vehicle body thereby producing hot spots in some areas and uncured paint in others. Further, the time to cure the painted body (cure time) of these ovens is relatively long due to its inherent inefficiencies requiring a long heat soak period to permit heat to reach hidden body areas.

A further drawback of prior ovens is that they employ a direct gas fired convection air zone utilizing high volumes of recirculated air requiring large filtration units to filter 100% of the air to decrease the probability of dirt contaminating the uncured paint. Additionally, during the cure process solvents are emitted from the paint and enter the recirculation ducting where they become deposited. Deposited and condensed solvents are a major source of dirt contamination since, as mentioned, they are located throughout the ductwork, both before and after the filtration unit. Major and costly cleaning operations are required during production shutdown periods to remove this buildup.

As mentioned, another drawback of this type of system is the excessive time required for oven heat-up as well as cool-down prior to and at the end of a production run. Normal oven heat-up and cool-down times are approximately one hour each. This long heat-up/cool-down requirement represents a considerable waste of energy. In addition, due to the construction of these ovens, vehicle bodies cannot be easily removed until the oven cools down. Consequently, if there is a production stoppage the vehicle bodies must remain in the oven during such stoppage resulting in damage and overcuring of the paint. In addition, if the production stoppage results from a problem inside the oven personnel can not enter the oven to investigate the problem until the oven has cooled down, one hour later.

It is an object of the present invention to provide an oven that can be used to both cure and cool a vehicle body and an oven characterized by reduced cure and cool times. A further object of the present invention is to uniformly and evenly distribute heat to the painted vehicle body. A further object of the present invention is to reduce heat loss and smoke and solvent contamination in the oven and to the surrounding environment thereby reducing maintenance intervals. A further object of the invention is to cure and cool a body without recirculating airflow. An additional object is to eliminate the requirement for lengthly oven heat-up and cool-down cycles thereby eliminating the need to remove the bodies from the oven during production stoppages. A further object of the present invention is to provide an oven in which the temperature curing profile can easily be varied to accommodate a staggered production line of varying body styles which may enter such oven in a sequential or predetermined manner. An additional object of the present invention is to provide an oven having reduced energy consumption.

Accordingly the invention comprises: an oven system for curing and cooling a painted vehicle body, the oven comprises: a lower structure defining an open top, a bottom, opposing end walls and side walls extending upwardly from the bottom. The side walls may include inwardly directed portions and the side and end walls cooperate to define the open top. The bottom, end walls and side walls may be thermally insulated to prevent heat loss. The oven is adapted to receive a separate carrier cover that can be raised, lowered and transferred relative to the open top to enclose the oven when positioned thereon. The oven and/or system additionally includes first duct means, for supplying fresh cooling air, at a first volume, into the interior of the oven and for exhausting such air therefrom. The first duct means may include a first air duct supported by one of the side walls and a second air duct supported by the other of the side walls, such ducts extending substantially along the length of side walls and spaced from the bottom and from the underside of the inwardly directed portions of the side walls. Each of the first and second air ducts may include at least one longitudinally extending outlet passage. Second duct means are provided for supplying fresh curing air at a second preferably higher volume to the interior of the oven and for exhausting such air therefrom. This second duct means may include a first plurality of air ducts supported by the first air duct, a second plurality of air ducts supported from the second air duct and a third plurality of air ducts supported upon the bottom. Each of the air ducts of the first, second and third plurality of air ducts extend longitudinally along the length of the oven; and include an open side through which is air communicated to the interior of the oven. A plurality of infra-red heating lamps are supported relative to the air ducts and positioned relative thereto such that cure air flows across lamps.

BRIEF DESCRIPTION OF THE DRAWINGS

Figure 1:
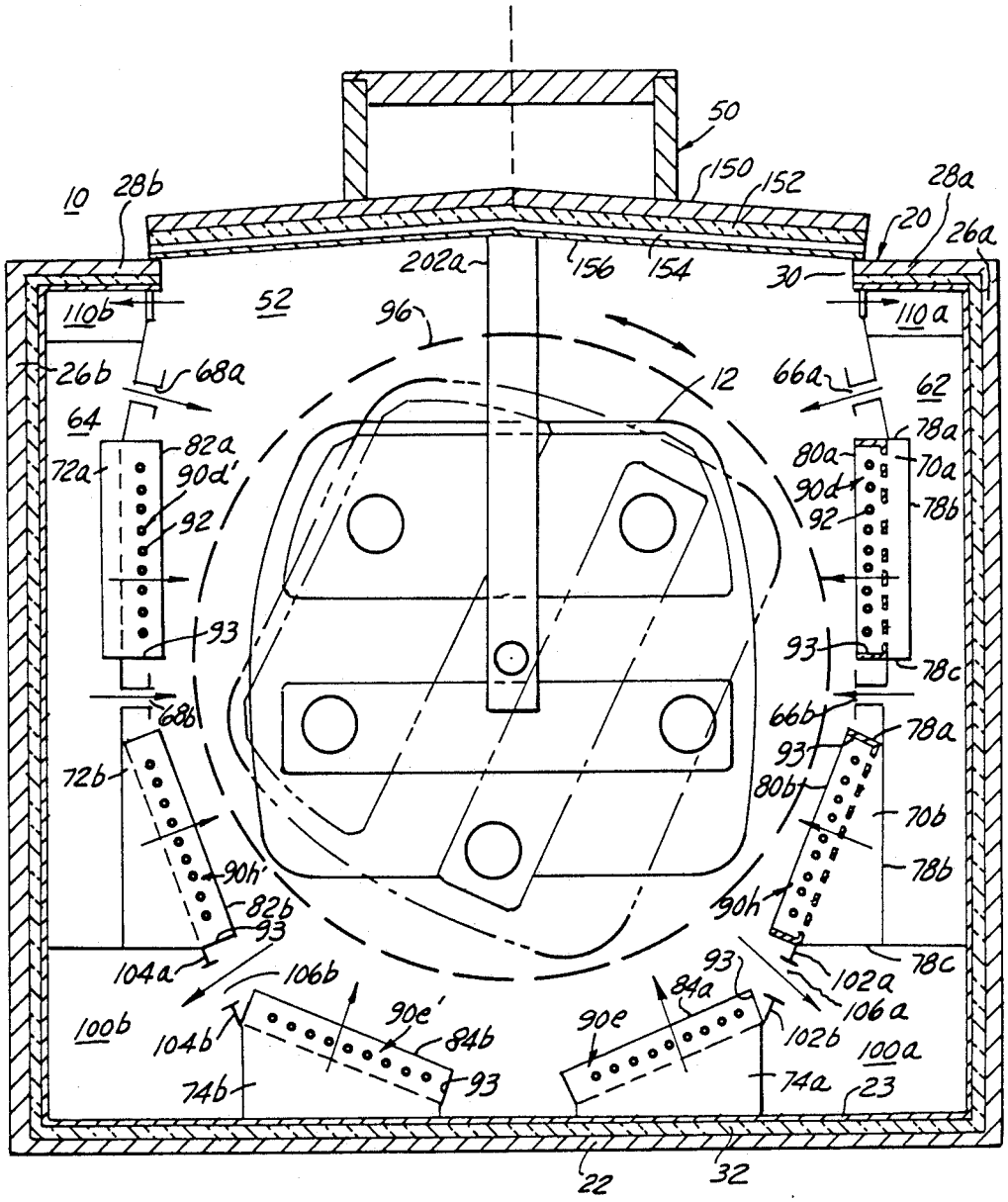

IN THE DRAWINGS:

FIG. 1 illustrates an end cross-sectional view of an oven incorporating the teachings of the present invention.

Figure 2:
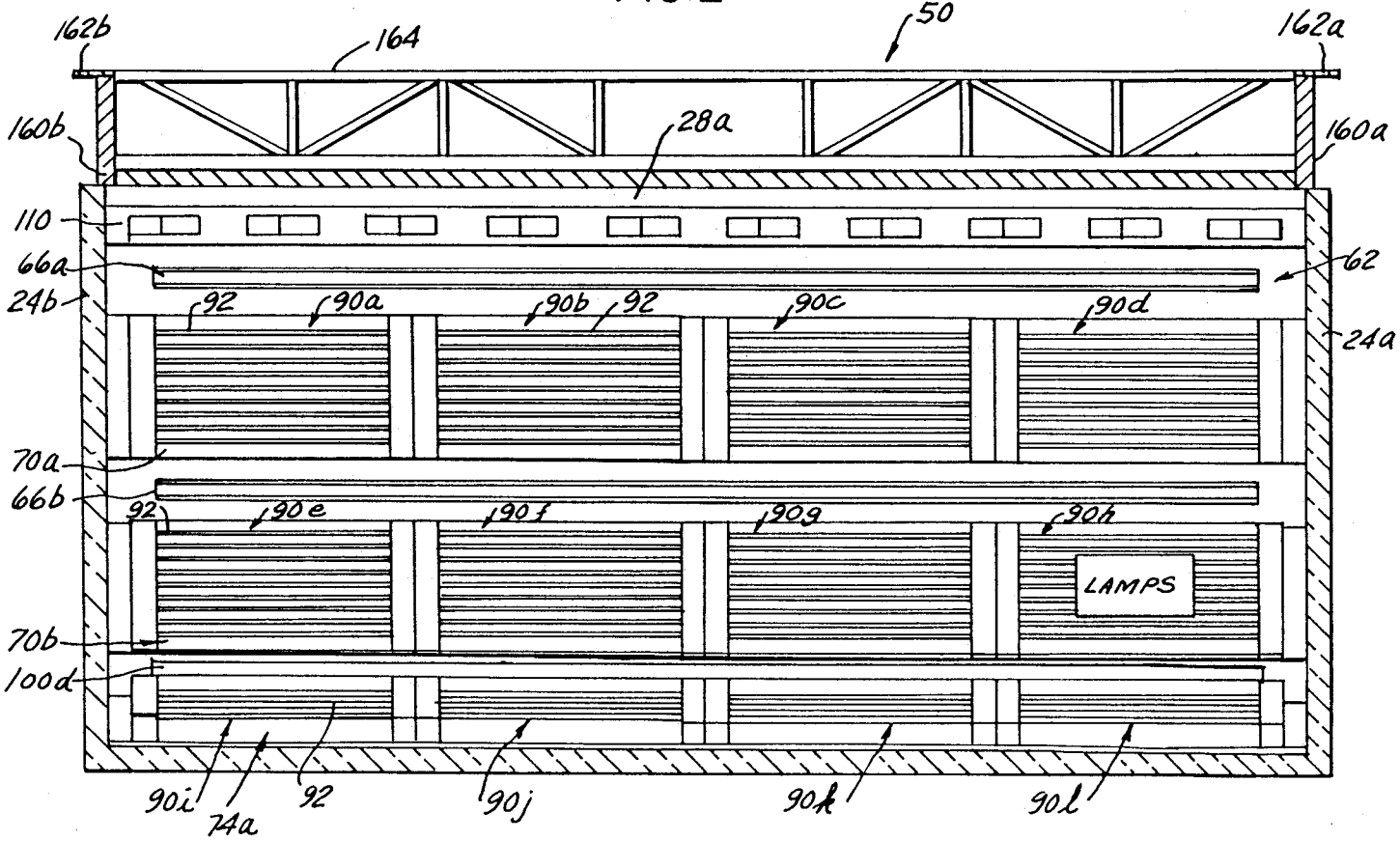

FIG. 2 illustrates a side cross-sectional view of the oven illustrated in FIG. 1.

Figures 3, 4:
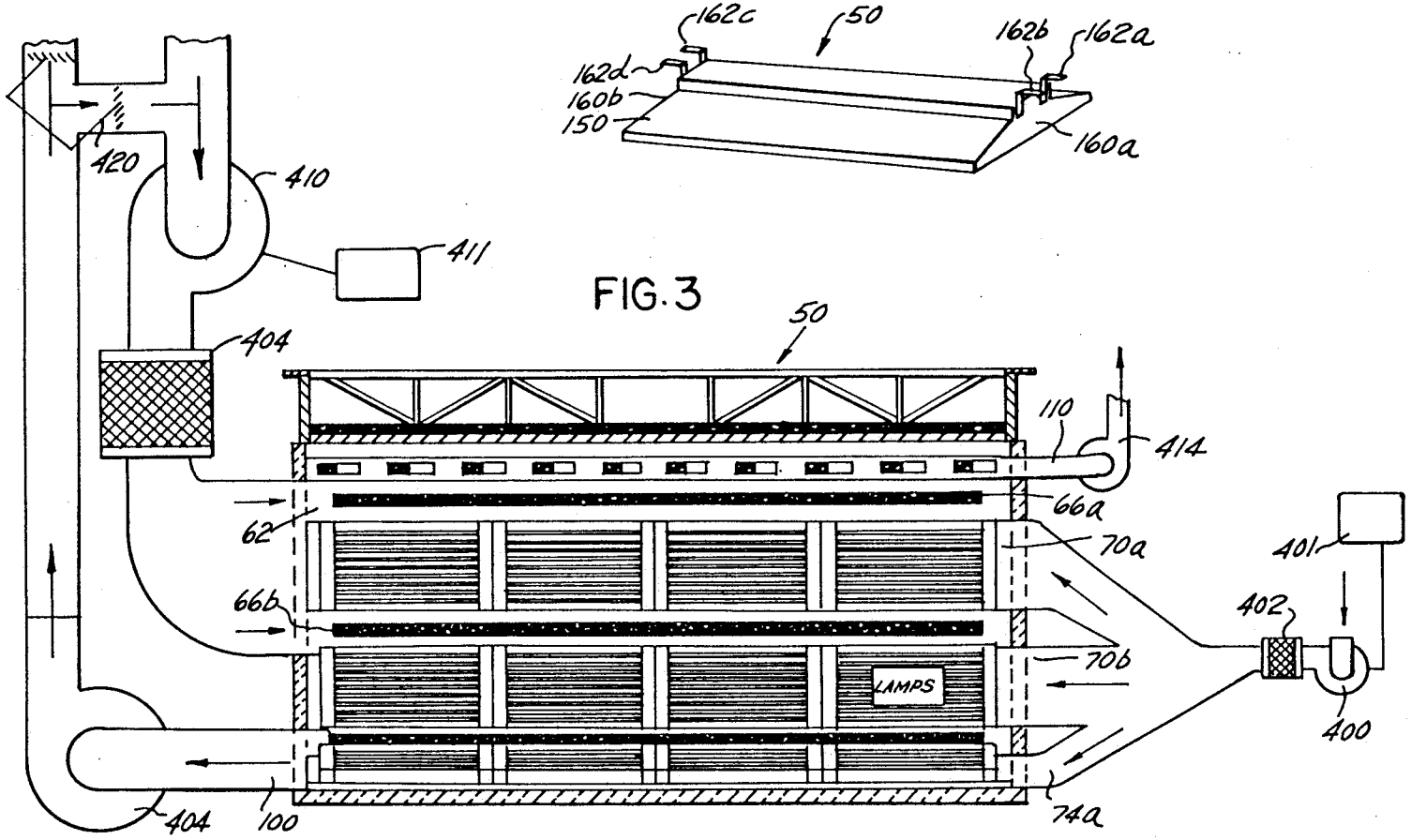

FIG. 3 further illustrates the air handling system employed by the present invention.

FIG. 4 illustrates a projected view of a cover.

Figure 5:
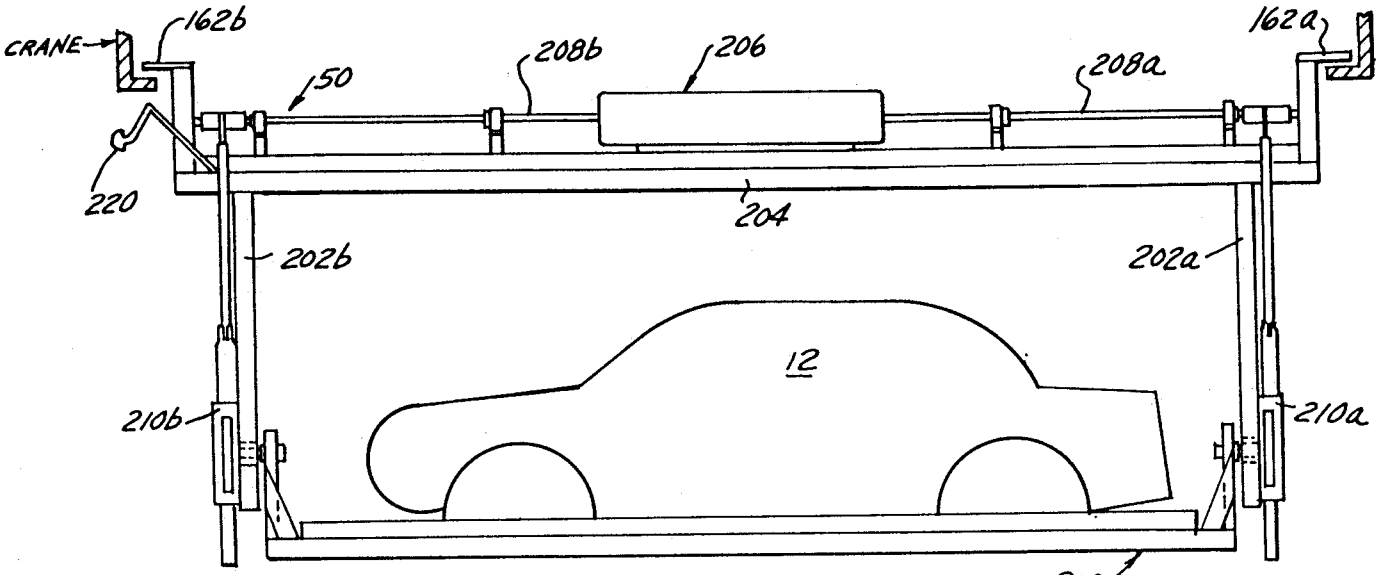

FIG. 5 illustrates another view of the carrier cover in a vehicle body.

FIGS. *6a,b* and *7a,b* illustrate exemplary lamp output intensity (input current) and temperature profiles.

DETAILED DESCRIPTION OF THE DRAWINGS

FIGS. 1–3 illustrate a system comprising oven 10 for the curing and cooling of a painted vehicle body shown as 12. The oven 10 comprises a generally rectangular shaped structure 20 defining an open top 30 and includes opposing end walls **24*a* and *b* and opposing side walls 26*a* and *b* which extend upwardly from a bottom 22. The side walls 26***a* and *b* may each further include an inwardly directed portion or ledge 28*a* and *b* respectively. The side walls 26, including the ledges 8, and end walls 24 and bottom 22 are preferably thermally insulated, such insulation shown as 32. The inner surfaces of the structure may also be covered by a reflective structural layer 23. This reflective layer also facilitates the cleaning of the oven. A carrier cover, generally shown as 50, is adapted to be raised and lowered by a crane mechanism, known to the art, relative to the open top for selectively enclosing the oven 10 such as when positioned upon the inwardly extending ledges 28 and top of the end walls 24. It should be noted that the cover is separate from the oven and that the carrier cover 50 and body 12 stay together as the they are moved into and out of various processing stations one of with is the above described oven. The carrier cover 50 includes means for rotatingly supporting the vehicle body 12 and is discussed in greater detail below. FIG. 1 diagrammatically shows the vehicle body suspended from a mast support by the carrier cover 50.

The oven 10 further includes first duct means which communicates a source of high volume, preferably prefiltered, fresh air into the interior (chamber) 52 of the oven, to cool the vehicle body 12. This first duct means may also include means for exhausting such air therefrom. The above source of air is also referred to as cooling air or cool-off air. The ducting and air source(s) are described in greater detail in FIG. 6.

The first duct means comprises a first air duct 62 supported by the side wall 26*a* and a second air duct 64 oppositely oriented and supported by the opposing side wall 26*b*. As can be seen from FIGS. 1, 2 and 3, the duct 62 extends substantially along the length of the side walls and is spaced from the bottom as well as from the underside of the inwardly directed ledges 28. Each of the first and second air ducts 62 and 64 respectively include at least one cool-air outlet passage. In the preferred embodiment of the invention, each air duct 62 and 64 includes two longitudinally extending air flow outlet passages 66*a,b* and 68*a,b*. FIG. 2 illustrates a plan view of passages 66*a,b*. The outlet passages are positioned longitudinally, along the side walls such that cool-air discharged therefrom can envelope the vehicle body 50.

The oven 10 further includes second duct means which also supplies fresh air to the chamber 52. For the purposes of the discussion below, the air exiting this second duct means is called curing air or cure-air which is typically supplied during the heating of the vehicle body 12 during the process of paint curing. This second duct means, as shown in FIG. 3, further includes means 414 for exhausting such cure-air from the interior 52 of the oven. As seen more clearly in FIGS. 1 and 2, the second duct means may comprise a first plurality of air ducts 70*a* and 70*b* supported by the first air duct 62 and a second plurality of air ducts 72*a* and b supported by the air duct 64. The second duct means further includes a third plurality of air ducts 74 *a,b* which are supported on the bottom 22. Each of the air ducts 70, 72 and 74 extend longitudinally parallel to the side walls 26*a* and *b* respectively, such that air exiting therefrom may envelope the body. Each of the ducts 70*a,b*, 72*a,b*, and 4*a,b* are substantially, rearwardly enclosed and include an open side or front respectively facing the interior or chamber 52. As an example, the ducts 70*a* and *b* include open fronts 80*a* and *b* and sides 78*a,b*, and *c* which isolate such air ducts from the cool-off supply air circulated through air ducts 62. Similarly, the ducts 72*a* and 72*b* include open fronts 82*a* and *b* corresponding enclosed rearward sides. In addition, the air ducts 74*a* and *b* also contain open sides 84*a* and *b* as well as enclosed sides.

A plurality of heating lamp units 90 are positioned across or within the openings or sides 80, 82 and 84 of the ducts 70, 72 and 74. FIG. 2 illustrates four of such units 90 (90*a,b,c,d*) arranged across the opening 80*a* while four additional units (90*e,f,g,h*) are positioned across the opening 80*b* of duct 70*b* and still another four units (90*i,j,k,l*) are positioned across the openings 84*a* of duct 74*a*. Such units may be fastened together in an appropriate manner such as at adjacent sides and secured to the end walls or ducts. A similar array of heating lamp units 90*a*'–90*l*' are supported across the openings of the ducts 72*a,b* and 74*b*.

Each of the heating lamp units 90 preferably comprise a plurality of spaced longitudinally extending infra-red heating lamps generally shown as 92 and reflectors or reflector housings 93. It is contemplated that such heating lamps are of the quartz, infra-red variety. The reflector housings 93 are positioned across corresponding open fronts of the ducts 70, 72, 74 and may be perforated to allow airflow thereacross. The intensity and temperature profile of the lamps are controlled by a control unit of known variety (not shown). A typical quartz lamp is manufactured by Thermal Devices of Mt. Clemans, Minn. It is of course desirable to use one type of lamp and that such lamp be able to cure paints of varying consistency and color. It can be appreciated that the various paints and colors will react differently to incident heat energy, that is, some paints and colors will tend to absorb energy while others tend to reflect it. Accordingly, it is preferable that the lamps operate at a wavelength that is substantially independent of paint color and type such that the light energy emitted from the lamps is absorbed by and thereby cure the painted bodies. It has been found that if the wavelength of the emitted heat energy is approximately 3–5 microns the lamps will by able to cure most, if not all, known colors and paint.

As will be discussed below, cure-air is forced through the second duct means and may exit each duct 70, 72 and 74 through corresponding perforated reflectors 93 to cure the prime coat. It is not a requirement of the invention to employ all of the ducts comprising the second duct means. As the cure-air passes across the associated lamps 92 it is heated. This heated air will migrate upwardly, enveloping the exposed surfaces of the body. It can be seen that the cure-air at a minimum need only be forced through bottom mounted ducts such as the lower ducts 74. As such, an alternate embodiment of the invention, the ducts 70 and 72 may be eliminated while retaining the reflector/lamp housing assemblies. In this case the housings may be solid instead of apertured since no forced air flows across these lamps.

It is contemplated that the vehicle body 12, after insertion into the oven 10, by the carrier cover 50 and rotatingly oscillated. One such means of oscillation is shown in FIG. 5. As the vehicle body 12 is oscillated, it will move through a circular arc or locus generally shown as 96 (see FIG. 1). As such, the present invention contemplates that each of the various arrays of lamps 92 will be located within the chamber 52 at fixed, preferably substantially equal distances from the locus of vehicle rotation. It should be appreciated that the above orientation is a preferred one and not a limitation of the invention. As the body is oscillated it passes in front of the various lamps. Such oscillating action averages the heat energy received by the body thereby preventing hot spots.

It is known that certain portions of the body are more massive than others and as such it will take a greater amount of energy to elevate the body to the cure temperature of the paint. As an example the portion of the body in the vicinity of the floor panel is often heavier than the side panels. In addition, the door hinges are often constructed of extremely thick or reinforced metal stock. As such, it is desirable to be able to control the heating of these portions while not overheating the thinner body portions. It is contemplated that the portions of the body requiring additional heat energy are first identified and by measuring or calculating the angle of rotation of the vehicle body, the spatial relationship between these heavier portions and each lamp can be calculated in a straight forward manner. As such, the output intensity of particular lamps can be increased to track these heavy body portions. It can be seen that as the vehicle is rotated the intensity of particular lamps will sequentially be increased, and then decreased to a lower level, such as a moving light on a theater marque. As a thinner body portion or panel is rotated in front of such lamps, the intensity is lowered so as not to overheat this thinner body panel.

The first duct means comprising the air ducts 62 and 64 and further includes means for exhausting the cool-off air from the chamber 52. This is accomplished by creating within the chamber 52 exhaust ducts 100*a* and *b* which can be formed by the sheet metal forming ducts 62, 70*b*, 74*a*, 64, 72*b* and 74*b*. Under certain circumstances it may be desirable to reduce the opening of the exhaust ducts 100*a* and 100*b*. This may be accomplished by throttling members 102*a,b* and 104*a,b* which extend from adjacent duct work. The inlets to the exhaust ducts 100*a*, 100*b* are generally illustrated as 106*a* and *b* respectively.

Further, as mentioned above, the second duct means includes means for exhausting such cure air supplied to the chamber 52. As can be seen from FIG. 1, exhaust ducts 110*a* and 110*b* are formed between the ducts 62 and 64 and corresponding inwardly directed ledges 28*a* and *b*.

FIG. 3 illustrates another side view of the oven and its air supply system. There is illustrated a source of cure-air such as fan 400 communicated to ducts 70 and 74. The fan 400 includes a motor and may be activated by a controller 401. A source of air for cooling includes a fan 410 is communicated to ducts 62 and 64. The fan 410 also includes a motor and may be activated by a controller 411. Filters 403 and 412 may be employed to filter the incoming air. The cure air exhaust ducts 110 are communicated to an exhaust fan such as fan 414 and exhaust ducts 100 may be communicated to an exhaust fan such as fan 404. Both fans 404 and 414 include motors and appropriate controllers. A bypass valve 420 may optionally be provided to communicate the exhaust flow to the input of the cool-air fan 410. Alternatively, the exhaust air may be communicated to atmosphere. A similar arrangement (not shown) may connect exhaust fan 414 and cure-air source fan 400. It should be appreciated that a similar ducting arrangement communicated to the above fans is provided for the ducting on the opposite side wall.

Reference is again made to the carrier cover 50 (FIG. 1) which comprises an outer metal shell or lid 150 underneath which is a layer of insulative material 152. Spaced from the insulative layer by an air gap 154, is an inner heat reflective layer 156 preferably fabricated of stainless steel. As can be seen from FIGS. 1 and 4, the cover 50 is preferably vaulted or raised along its axis of symmetry. The purpose of the insulative layer 152 is, of course, to prevent heat loss through the open top 30 while the reflective layer 156 serves to maintain the maximum amount of heat within the oven 10. The spacing of the reflective layer 156 apart from the insulative layer 152 by the air gap 154 further serves to maintain a temperature differential between the reflective layer 156 and the outer layer 150 of the cover 50 such as to avoid the formation of condensation on the reflective layer which could accumulate and fall upon the uncured painted vehicle body 12. Condensation occurs when a vapor comes in contact with a surface at a temperature lower than the condensation temperature of the vapor. When the vehicle body and cover enter the oven they are both below the vapor condensation temperature. The vapor does not form until the uncured painted surfaces reach an elevated temperature during the cure cycle. If the cover can be heated to a temperature equal to or above the vapor condensation temperature prior to the formation of the vapor, then condensation on the cover will not occur. Since the reflective layer of the cover is preferably constructed of a gage thickness less than that of vehicle bodies, it will heat up quicker than the body. The air gap between the cover and the insulative material additionally reduces the possibility of conductive heat losses which might slow down the heating up of the reflective layer. In addition, the reflective layer re-radiates heat back to the upper sections of the body.

The cover 50 further includes end surfaces 160*a,b* which in combination with the above described portions of the cover fully enclose the structure 20. As mentioned above, the cover 50 is raised, lowered and transferred to various stations by a crane mechanism of known construction which engages the axially directed pick-up arms 162*a–d*. Additional structural support is provided by a cross-member 164.

FIG. 5 illustrates other features of the carrier cover 50. The vehicle body is supported and attached to a platform 200 which is rotationally supported by masts 202*a* and *b*. The masts in turn extend down from a support structure 204 which may be the metal lid 150 (shown in FIG. 1). Located atop the support structure 204 is a motor 206 and drive links 208 *a* and *b*. The drive links are connected to a drive mechanism such as a rack and pinion gear arrangement 210 a and b. The motor and drive links may be enclosed as illustrated in FIG. 4. These gear mechanisms are connected to the platform to oscillate the body 12. To facilitate on and off loading of the vehicle body the platform 200 may be separate from the carrier cover and engaged by pick-up arms. Various on and off loading techniques can be found in the art. Extending from the top portion of the cover are two of the arms 162 (see FIGS. 4 and 5) which are engage by the crane to raise, lower and translate the cover 50. When the cover is atop the oven 10 power must be supplied to permit the vehicle to be oscillated by the motor 206 and gearing. FIG. 5 also illustrates a power pick-up arm 220 which would engage a power receptacle (not shown) located proximate the oven or attached thereto. The specific details of the crane, motor 204, platform 200 gears 210, and electrification are generally available in the art and may be configured as required by the particular system (see European Patent Application No. 84 402 290.5 "Electrodeposition System and Method Thereof" which is incorporated herein by reference).

The following describes the basic operational sequences of the oven. Prior to the entry of the vehicle body 12 into the oven 10, the oven is maintained at a preload or ready condition. During this condition the quartz lamps 92 are off while cure-air supply is introduced through ducts 70 and 72 by activating the fan 400. If the volume of cure-air is sufficiently large by operating the cure-air supply, a positive pressure differential is maintained in the open oven during the preload condition thereby minimizing the influx of particulates which may contaminate the uncured paint. Further, during this preload condition the cool-air supply 410 is turned off. The crane mechanism mentioned above, translates the cover 50 and vehicle body 12 attached thereto to a position above the opening 30. thereafter the cover 50 is lowered onto the opening 30 hereby sealing the oven 10 and suspending the vehicle body within the now formed enclosed chamber 52. The cover and vehicle are left in the oven upon disengagement with the crane.

After loading the vehicle body 12 into the oven 10, the plurality of quartz lamps 92 are activated by its associated controller. During the heat-up of the quartz lamps 92 the vehicle body 12 is rotatingly oscillated through an arc of approximately ±65° which effectively exposes the radiation from the quartz lamps to the various inner and outer surfaces of the vehicle body 12. The fact that the vehicle body 12 can be oscillated relative to the various quartz lamps distributes heat evenly throughout and decreases the possibility of hot spots that are created in conventional heating ovens. As can be seen from the above, the vehicle body is primarily heated by infra-red radiation emanating from the quartz lamps. This heat transfer is further optimized by permitting the cure-air supply to be forced across the quartz lamps and directed toward the vehicle body. As the ambient cure-air passes over the lamps, it picks up heat and directs it toward the body thereby increasing efficiency. Convection heat transfer is also induced by the oscillating motion of the vehicle body. In addition, as the cure-air passes over the curing paint on the body it is co-mingled with smoke and fumes from the curing paint which is removed from the chamber 52 through the cure-air exhaust ducts 110*a* and 110*b* and exhaust fan 414 (see FIG. 3).

Figure 6B:
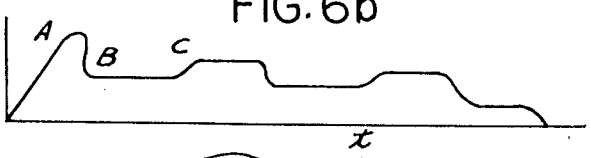
Figure 7B:
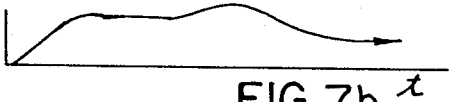
Figure 6A:
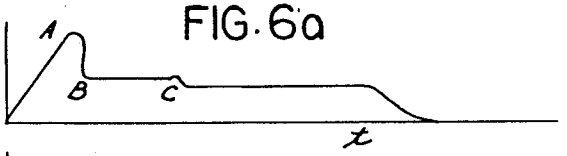
Figure 7A:
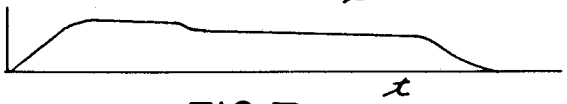

FIG. 6*a* illustrates a typically output intensity of a particular lamp or set of lamps. Since a low mass lamp is used its output intensity is rapidly brought to a level (point A). Thereafter the intensity is reduced to a holding level (point B) sufficient to rapidly bring the body temperature to the cure temperature of the paint. Thereafter the intensity of the lamps may be reduced to a maintenance temperature sufficient to continue cure the paint for the remainder of the cure cycle. The intensity levels at points B and C are chosen to be sufficient so as not to over cure the thinner body panel portions. FIG. 7*a* illustrates an exemplary temperature profile of a particular portion of the vehicle body. During the remaining interval of the curing cycle the inner surfaces and hard to heat hidden surfaces of the vehicle body will gradually be brought up to this desired lower curing temperature. More specifically, as the outer surfaces of the vehicle body are maintained at a substantially constant temperature, the inner surfaces of the vehicle body will be brought up to such temperature by conduction through the skin of the vehicle and by the convection induced by oscillation and the continuous influx of air from the cure-air ducts 70, 72 and 74 supplied by fan 400. The heat-up cycle or temperature profile necessary for properly curing a particular vehicle body style will necessarily vary with the mass and overall configuration of the vehicle body.

FIG. 6*b* illustrates another output intensity curve which can be used in the present invention when the output intensity is varied to track the more massive body portions. As an example, the output intensity can be rapidly brought from zero to an output (point A) and thereafter to a holding level (point B) after a predetermined time sufficient to heat a thinner body panel. The lamp intensity can be increased (point C) when a heavier body part is moved in its proximity and thereafter reduced to the lower level sufficient to heat the thinner body panels. FIG. 7*b* shows a corresponding temperature profile.

After the cure cycle has been completed, the quartz lamps 94 are turned off. However, the cure-air supply is maintained on to continue to pass air across the quartz lamps rapidly cooling same to reduce residual heat which may be input into the oven during this cool-off cycle. As mentioned, the ability to rapidly cool the quartz lamps is in part a result of the fact that such quartz lamps are characterized by a relatively low thermal mass. Such thermal mass also permits their temperature to be rapidly varied. Simultaneously with maintaining the cure-air supply 414 on, the cooling-air 404 and exhaust supply 410 are activated to introduce additional air at high volume and velocity into the chamber 52. During this cool-off period, the vehicle body is oscillated relative to the cool-off supply passages 66 and 68 enhancing the rapid cooling of the vehicle body and further causes a wiping action across the body exposing nearly all of the body surfaces to the cool air supply.

The cool-off cycle is maintained until a greater portion of the heat from the vehicle body has been lost. At this point the cool-off air supply 404 is shut off and the oscillation of the vehicle body is terminated. The cure-air supply is maintained on as the crane lifts the now cured and cooled vehicle body, with cover out of the oven. Since the heat from the oven was purged during the cool-off cycle and the lamps are now off only a minimum amount of heat is released to the surroundings when the cover is opened.

Many changes and modifications in the above described embodiment of the invention can, of course, be carried out without departing from the scope thereof. Accordingly, that scope is intended to be limited only by the scope of the appended claims.

I claim:

1. A system for heating and curing a previously painted object and for thereafter cooling same, comprising:

an open top oven (10);

carrier cover means (50) adapted to enclose the oven and for suspending the object therein;

cure air means for delivering heated air to the interior of the oven and for directing the cure air at the object to cure the paint on the object;

means for delivering cool air to the interior of the oven and for directing such cool air at the previously cured object wherein the cure air means includes at least one outlet and wherein the cure air means further includes at least one air heater element disposed across the at least one to heat the air as it passes thereacross.

2. The system as defined in claim 1 wherein the at least one air heater element includes a plurality of electric quartz lamps.

3. The system as defined in claim 1 wherein the wavelength of the heat energy emanating form the quartz lamps is between 3–5 microns.

4. The system as defined in claim 1 wherein additional air heater elements are disposed within the oven, remote from the first duct, and oriented about the object.

5. The system as defined in claim 4 wherein the cure air duct means includes additional air ducts for communication curing air to and through the additional air heater elements.

6. The system as defined in claim 1 wherein the cool air means includes-cool air duct means for communicating cool air to the object and wherein the cool air means is operative after the object has been cured.

7. A system for heating and curing a previously painted object and for thereafter cooling same, comprising:

an open top oven (10);

carrier cover means (50) adapted to enclose the oven and for suspending the object therein;

cure air means for delivering heated air to the interior of the oven and for directing the cure air at the object to cure the paint on the object;

means for delivering cool air to the interior of the oven and for directing such cool air at the previously cured object wherein the cool air means includes cool air duct means for communicating cool air to the object and is operative after the object has been cured and wherein the cool air means includes second exhaust means for exhausting air from the oven during the cooling of the object.

8. The system as defined in claim 7 wherein the carrier cover means includes means for oscillating the object relative to the cure air and the cool air.

9. The system as defined in claim 8 wherein the oven includes insulated walls and an insulated bottom.

10. The system as defined in claim 9 wherein a reflective material covers the insulation.

11. The system as defined in claim 9 wherein the carrier cover means includes a lid, which encloses the oven, including a layer of insulation facing the interior of the oven, and a reflective layer spaced from the insulation by an air gap.

12. The system as defined in claim 11 wherein the reflective layer is metal and wherein the object is metal and wherein the gage thickness of the reflective layer is less than the gage thickness of the object.

13. An oven for curing and cooling a painted vehicle body comprising:

a substantially rectangular structure (20) defining an open top (30), a bottom (22), opposing end walls (24*a,b*) and side walls (26*a,b*) extending upwardly from the bottom;

the side walls (24*a,b*) including inwardly directed portions (28*a,b*), the side and end walls cooperating to define the open top (30), wherein the bottom, end walls and side walls are thermally insulated;

a cover (50), adapted to be raised and lowered relative to the open top (30), for enclosing the structure when positioned thereon and for supporting a workpiece such as a vehicle body (10);

first duct means (60,64,100), for supplying fresh air at a first volume into the interior of the structure (20) and for exhausting such air therefrom; including a first air duct (62) supported by one of the side walls (26*a*) and a second air duct (64) supported by the other of the side walls (26*b*), such air ducts extending along the length of side walls and spaced from the bottom (22) and from the underside of the inwardly directed portions (28) of the side walls;

each of the first and second air ducts (62,64) include at least one longitudinally extending outlet passage (66*a,b*;68*a,b*);

second duct means for supplying fresh air at a second higher volume to the interior of the structure and for exhausting such air therefrom; including a first plurality (70*a,b*) of air ducts supported by the first air duct (62), a second plurality (72*a,b*) of air ducts supported from the second air duct (64) and a third plurality of air ducts (74*a,b*) supported upon the bottom (22), each of the air ducts of the first, second and third plurality of air ducts extend longitudinally along the length of the structure (20); and include an open side (76*a,b*;78*a,b*;80*a,b*) through which air is communicated to the interior of the structure (20);

a plurality of heating lamps (92) having a low thermal mass are supported relative to the first, second and third plurality of air ducts and positioned relative thereto such that the air flow emanating from such ducts flows across corresponding ones of the lamps.

14. The oven as defined in claim 13 including means for selectively supplying air to the first and second duct means.

15. The oven as defined in claim 13 wherein such heating lamps are substantial equi-distant from an axis (94) extending the length of the structure, about which the vehicle body is oscillated.

16. The oven as defined in claim 13 wherein the cover (50) comprises a layer (100) of thermally insulative material (152) and a layer (156) of heat reflective material, facing the interior of the structure (20), spaced from the insulative layer by an air gap (154).

17. The oven (10) as defined in claim 16 wherein the cover, insulative layer and reflective layer, along a central longitudinally extending plane (108), are elevated.

18. The oven as defined in claim 16 wherein the cover (50) includes second means for rotationally supporting the vehicle body (12) and means (51,93) for rotatingly oscillating the vehicle body relative to the lamps (92), outlet passages (66,68) and inlets (80,82,84) in response to control signals input thereto.

19. The oven as defined in claim 16 wherein the second means includes an electric motor (51) drivingly connected to a platform (95) upon which the vehicle body is secured.

20. The oven as defined in claim 19 wherein each lamp is generally tubular in construction and arranged in longitudinally extending arrays (90) wherein each array comprises a plurality of spaced heating lamps (92).

21. The oven as defined in claim 20 wherein each lamp of the plurality of infra-red lamps is an electric, quartz heating lamp.

22. The oven as defined in claim 21 wherein associate with each lamp is a reflector (93).

23. The oven as defined in claim 22 wherein certain ones of the reflectors are connected to various ducts and are apertured to permit air flow thereacross.

24. The oven as defined in claim 20 including means for varying the intensity of certain lamps in correspondence with the oscillating motion of the vehicle body and the density of various vehicle body portions.

25. The oven as defined in claim 24 wherein the vehicle body comprises thick metal areas and wherein the intensity of the lamps are variably controlled in correspondence with the motion of the thick metal areas.

26. In an open top oven (10) comprising a removable cover (50) for enclosing the oven and means (51,94,98) for rotatingly suspending a painted object, first duct means (62,64,100) for introducing cool-air, second duct means (70,72,74) for introducing cure-air, a plurality of controllable infra-red lamps suspended across openings in the second duct means, a method comprising the steps of:

(a) loading the cover (50) upon the oven to insert the object therein;

(b) activating the lamps (92) to heat the painted object;

(c) rotatingly oscillating the body relative to the lamps and to the cure-air flowing thereacross;

(d) deactivating the infra-red lamps while still permitting cure-air to flow thereacross to rapidly cool same;

(e) energizing the cool-air supply to cause air to flow through the first duct means to reduce the temperature of the previously heated vehicle body.

27. The method of claim 26 further includes the step of maintaining a positive pressure differential within the oven prior to entry of the object, including activating a cure-air supply to cause air to flow through the second duct means.

28. The method of claim 26 wherein the step of reducing object temperature is determined after a predetermined time period.

29. The method of claim 28 wherein after the object is cooled, oscillation is halted and is removed from the oven (10).

30. The method as defined in claim 26 wherein the step of activating the lamps includes increasing lamp output to a first level and thereafter reducing such output to a lesser holding level.

31. The method is define in claim 30 wherein the intensity of the lamps is varied during the oscillation of the object to follow the movement of more dense sections thereof.

* * * * *